United States Patent [19]

Pargamin et al.

[11] 4,331,833

[45] May 25, 1982

[54] INSULATOR COMPRISING A PLURALITY OF VULCANIZED FINS AND METHOD OF MANUFACTURE

[75] Inventors: Laurent Pargamin; Denis Thuillier, both of Vichy, France

[73] Assignee: Societe Anonyme dite: CERAVER, Paris, France

[21] Appl. No.: 168,232

[22] Filed: Jul. 10, 1980

[30] Foreign Application Priority Data

Jul. 11, 1979 [FR] France ..... 79 18031

[51] Int. Cl.[3] ..... H01B 3/28; H01B 17/58; H01B 17/66

[52] U.S. Cl. ..... 174/179; 156/267; 156/304.2; 156/304.3; 156/304.6; 156/306.9; 156/333; 156/338; 156/294; 174/80; 174/110 AR; 174/209

[58] Field of Search ..... 156/304.2, 304.3, 304.6, 156/306.9, 313, 333, 338, 267, 51, 52, 252, 294; 174/80, 110 AR, 178, 179, 209

[56] References Cited

U.S. PATENT DOCUMENTS

| | | | |
|---|---|---|---|
| 1,899,067 | 2/1933 | Trumbull | 156/304.3 |
| 3,635,504 | 1/1972 | Borden et al. | 156/304.2 |
| 3,663,333 | 5/1972 | Palfreyman | 156/267 |
| 3,880,693 | 4/1975 | Urlings et al. | 156/333 |
| 3,952,848 | 4/1976 | Walker et al. | 174/179 |
| 4,082,592 | 4/1978 | Raabe et al. | 156/304.6 |
| 4,198,538 | 4/1980 | Lusk | 174/179 |
| 4,212,696 | 7/1980 | Lusk et al. | 156/294 |
| 4,233,102 | 11/1980 | Fisher | 156/338 |
| 4,246,696 | 1/1981 | Bauer et al. | 174/179 |

*Primary Examiner*—Michael G. Wityshyn
*Attorney, Agent, or Firm*—Sughrue, Mion, Zinn, Macpeak and Seas

[57] ABSTRACT

An insulator comprising a plurality of fins (1) or one-piece groups of fins made of elastomer and having sleeves (2) disposed end-to-end. The fins surround a central member (3) and are vulcanized. The fins form a water-tight tube whose cohesion is ensured at least by vulcanizing intermediate elastomer portions (5) which are inserted raw between vulcanized fins or one-piece groups of fins and adhere to the facing surfaces of the said sleeves by virtue of their subsequent vulcanization.

8 Claims, 9 Drawing Figures

INSULATOR COMPRISING A PLURALITY OF VULCANIZED FINS AND METHOD OF MANUFACTURE

The invention relates to insulators of the type comprising a plurality of vulcanised fin units made of elastomer and including a central sleeve portion. The units are placed end-to-end with their sleeves surrounding a central member, which may, for example, comprise a composite rod of glass fibres constituting the core of an electrical insulator member of the insulating bar-type; or alternatively the central portion may comprise a support such as is used for the end of a high-tension cable, a lead-through, or an insulator core for cut-out chambers.

BACKGROUND

It is known to make insulators that are essentially constituted by a rod of resin or glass fibres bonded by resin, with the said rod being covered with a vulcanised sheet and/or with vulcanised fins. Two methods are commonly used to cover the rod: either the system of fins is moulded en masse on the rod, or else independent fins are threaded over the rod (which is usually sheathed) and are then glued end-to-end on the rod. The first method is advantageous for protecting the rod since it is possible to obtain a continuous covering of the rod. However, it lacks flexibility since each different size of insulator requires a different mould, and further the undercut portions of the fins present difficulties, particularly on long insulators. The second method has two drawbacks: firstly, the fins often require the presence of an adhesive or adhesion primer, generally in the form of a liquid that often contains solvents; secondly, the inter-sleeve joint between fins does not protect the rod sufficiently, in particular against ingress of moisture. This is very inconvenient for use with high-tension insulators because of the high risk of electric arcs occurring at the joint, said arcs damaging the protection of the rod and sometimes making the whole assembly unusable as an insulator.

Preferred implementation of the present invention provides a simplified version of the above mentioned second method, which avoids the use of a foreign body such as an adhesive or an adhesive primer, and obtains an insulator which is reliable over time, both electrically and mechanically.

THE INVENTION

The present invention provides a method of manufacturing an insulator, the method comprising the steps of:

providing a plurality of fin units made of elastomer material, each fin unit comprising a sleeve surrounding a bore, two end faces, and at least one fin projecting generally outwardly from said sleeve;

vulcanising said fin units;

providing washers of raw elastomer material and extending over an area at least equal to the area of the end faces of the sleeves;

assembling the fin units in end-to-end relationship with their bores in alignment and with a washer held between adjacent pairs of sleeve end faces; and vulcanising the washers in situ to form a single multi-fin insulator.

Preferably said washers in the raw state are in the form of pierced portions of thin sheet material with outside dimensions greater than the outside dimensions of the sleeve end faces and wherein the excess sheet material is removed after vulcanisation of the washers.

Generally the same elastomer material is used both for the fin units and for the washers.

The aligned bores of the sleeves are used to hold a central member. This member may be conductive (e.g. the end of a high tension cable or cross-over) or insulative (e.g. a composite rod of resin bonded fibres. The central member may be covered with a layer of silicone grease or like material or it may be bonded to the sleeves of the fin units by vulcanisation of an outer layer of raw elastomer at the same time as the washers are vulcanised.

DRAWINGS

Other characteristics and advantages of the invention will appear more clearly in the light of the following description given by way of non-limiting example with reference to the accompanying drawings in which.

DETAILED DESCRIPTION

It is important to make clear that throughout the following description although only single-fin units are described and illustrated, one-piece groups of fins could equally well be used instead. The word "fin" is used on its own simply to avoid repeating the alternative "one-piece groups of fins" whenever "fin" is mentioned in the description.

Figure 1:
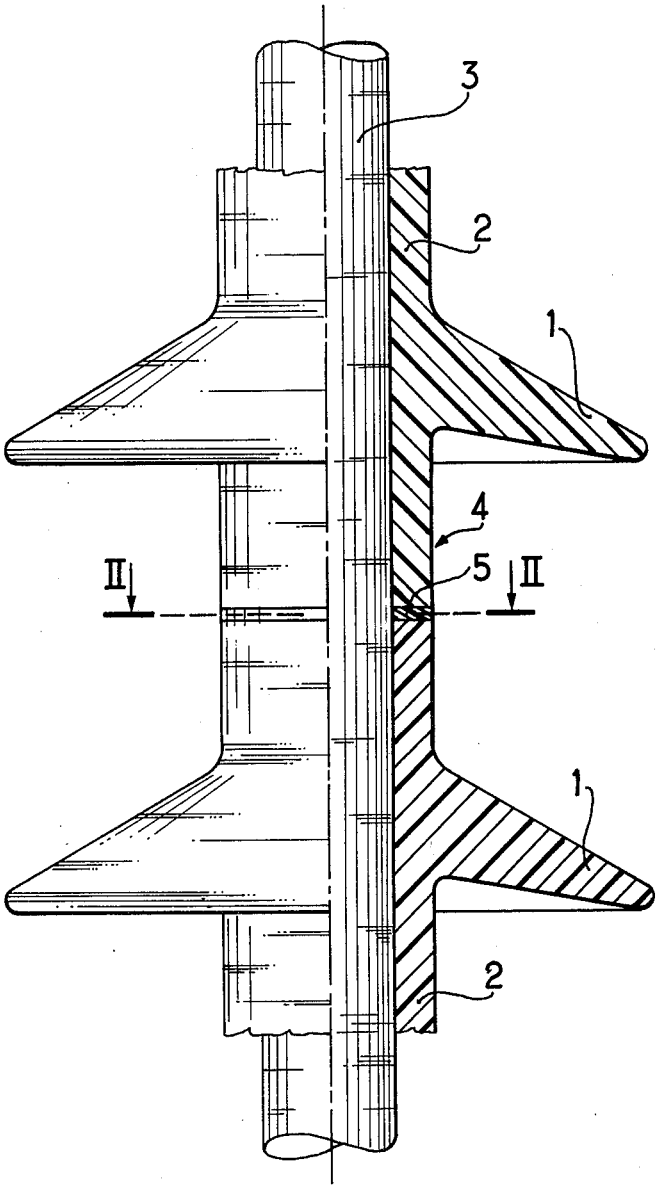
FIG. 1 is a partial axial section through an insulator in accordance with the invention, and constituted by a central support member covered with a water-tight finned tube having inter-sleeve adherization washers.

In FIG. 1, an insulator comprises a plurality of elastomer fins 1 having sleeves 2 placed end-to-end and surrounding a central member 3. The fins are vulcanised. In accordance with the invention, the fins together with their sleeves form a water-tight tube 4 whose cohesion is ensured at least by vulcanisation of intermediate elastomer portions 5 inserted in the raw state between adjacent fins and very strongly bonded by vulcanisation (adherized) to the facing end surfaces of the said sleeves. The term "tube" as used above, must be understood in a broad sense, and in particular it need not necessarily have a cylindrical bore as may, for example, be the case in the application of insulators to cut-out chambers having a turning core which forms a non-cylindrical central member (it may have a bulging shape for example). In this case the intermediate inter-sleeve portions 5 are thin rings having substantially the same outer perimeter as the sleeve 2 of the fins, and being manufactured as is described below, from a thin sheet which forms a removable washer that is inserted in the raw state between adjacent sleeves. The elastomer used will advantageously be an ethylene-propylene rubber such as EPDM and preferably the same elastomer will be used for the fins as for the intermediate adherization rings.

In FIG. 1, the water-tight tube 4 is freely threaded over the central member 3 and is separate therefrom. The support constituted by the central member may take diverse forms with a few examples being given with reference to FIGS. 2A to 2E.

Figure 2A:
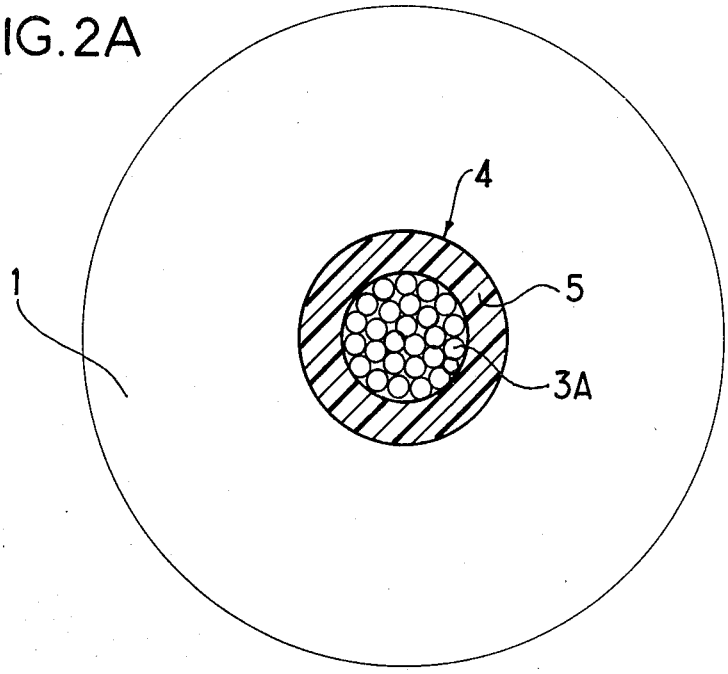
FIGS. 2A to 2E are cross-sections through II—II in FIG. 1 illustrating various different types of central member (the fins are shown in FIG. 2A only in order to clarify the drawings)

In FIG. 2A, the support is a cable 3A: it may, for example, be the end of a high-tension cable, the cable may be covered with a substance such as silicone grease, the water-tight tube 4 providing complete protection for the end of the cable.

Figure 2B:
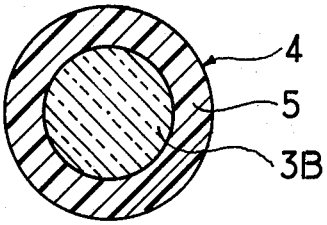

In FIG. 2B the support is a rod 3B of composite material comprising organic or inorganic wires or fibres bonded by a synthetic resin, for example, glass fibres bonded by an epoxy resin. The rod would constitute the core of an electrical insulator which may be covered with a substance such as silicone grease.

Figure 2C:
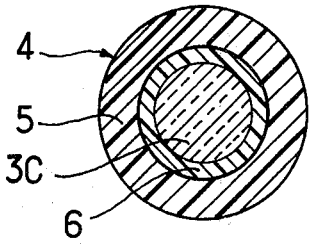

In FIG. 2C the support is a rod 3C of composite material similar to the preceding one, covered in the raw state by a protective vulcanised sheath preferably made from the same elastomer as are the fins and the intermediate adherization rings. The sheath may be covered with a substance such as silicone grease.

Figure 2D:
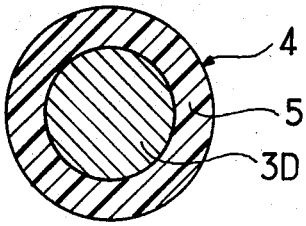
Figure 2E:
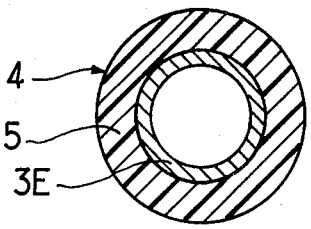

In FIGS. 2D and 2E, the support is respectively a bar 3D and a hollow tube 3E, made of metal for example and forming the core of a crossover.

Other types of support may be mentioned, for example, a hollow insulating tube (of glass fibres) and a non-cylindrical body of revolution such as that mentioned above (for application to insulators in cut-out chambers).

Figure 3:
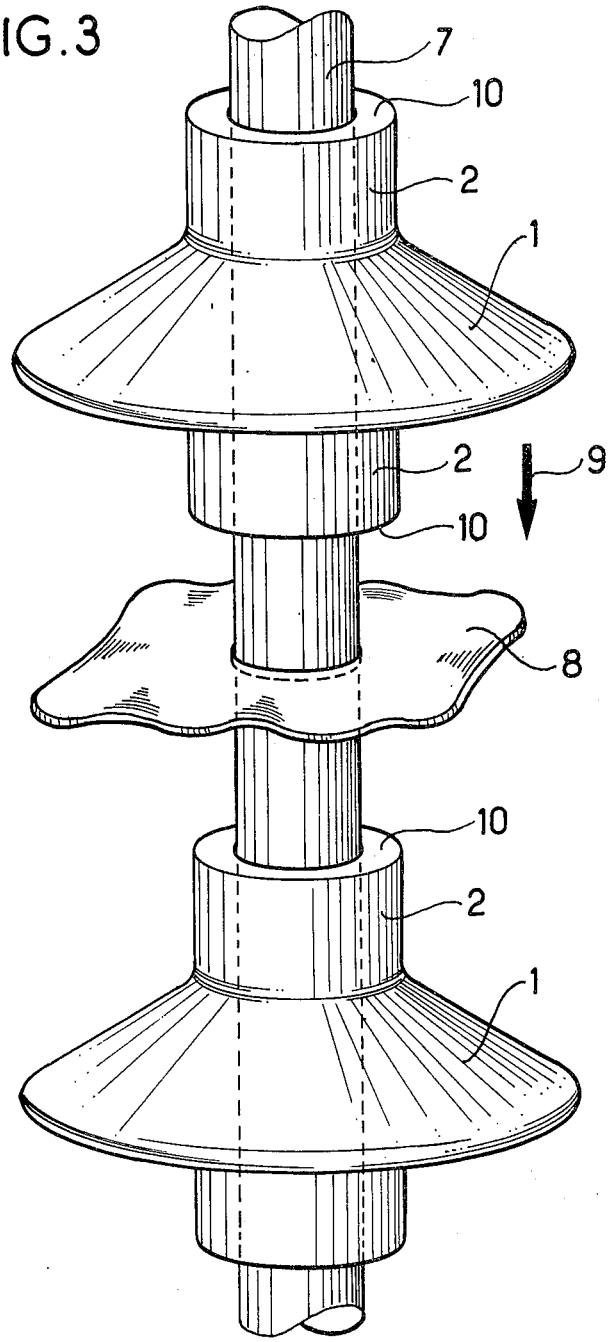
FIG. 3 is a perspective view of the water-tight tube of FIG. 1 being assembled over a temporary support, and in particular shows how the adherization rings are obtained from removable washers.

The assembly of the water-tight tube is shown schematically in FIG. 3. A series of vulcanised fins 1 is stacked on a provisional support 7 (with the number of fins being chosen to match the final size of the insulator) and in between each pair of adjacent sleeves 2 a thin sheet 8 of raw elastomer is inserted. The threaded assembly is preferably slightly compressed (arrow 9) in order to ensure good contact between the faces 10 of the sleeves 2 and the thin sheet 8 (on both sides thereof), and is then disposed in an autoclave (not shown). Heating increases the compression of the thin sheet 8 between the facing sleeves, thereby ensuring a high degree of cohesion during vulcanisation of the sheets by expelling any bubbles of air that may exist, and then giving rise to a slight circular constriction of the sheets facilitating the subsequent tearing-off of the unwanted portions after vulcanisation, to leave only the inter-sleeve rings without any projecting portions at the joints.

The water-tight tube obtained in accordance with the invention presents improved performance over prior embodiments comprising a glued stack of fins. Mechanically speaking, it is observed that the force necessary to tear the fins apart for a given cross-sectional area is increased from 100 kg to 175 kg without heat treatment, and from about 110 kg to 205 kg after spending two hours in a bath of boiling water, thereby showing the improvement obtained in tearing strength. Electrically speaking, it has been observed that the voltage per millimeter of thickness necessary for perforating the tube has risen from about 2.2 KV/mm to 5.1 KV/mm, which shows a marked improvement in resistance to perforation.

For some applications, such as electrical insulators for high tension lines having a central core constituted by a rod of composite material, it may be advantageous to further reinforce the cohesion of the water-tight finned tube by providing in addition a degree of adherization between the rod and the tube by vulcanising an intermediate adherization portion that is disposed in the raw state between the said rod and the sleeves of the fins. In such a case, it should be understood that the raw adherization parts will be vulcanised simultaneously such that the water-tight tube is made at the same time as its inner surface is adherized to the rod, as opposed to the preceding variants in which the tube was made separately on a provisional support and subsequently threaded onto the desired support.

Figure 4:
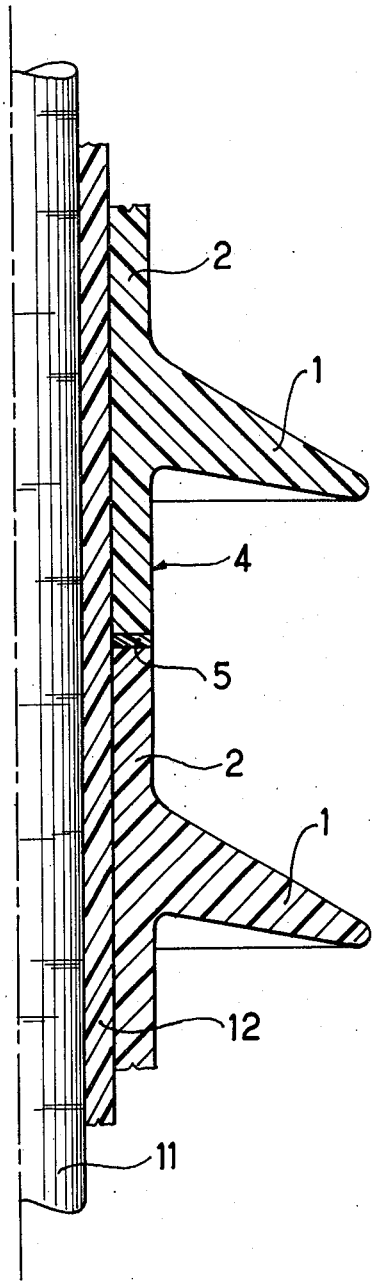
FIG. 4 is an axial section through a variant of an insulator in accordance with the invention, using vulcanisation of a raw sheath between the rod and the fins.

Thus, in FIG. 4, the rod 11 (analagous to the support shown in FIG. 2B) is covered with an elastomer sheath 12 by extrusion of raw elastomer. The vulcanised fins are then threaded over the raw portion and the thin sheets, likewise in the raw state are interposed between the fins. The raw portions are vulcanised together providing double adherization, firstly as above between the sleeves by virtue of the rings 5, and secondly between the rod and the sleeves.

Figure 5:
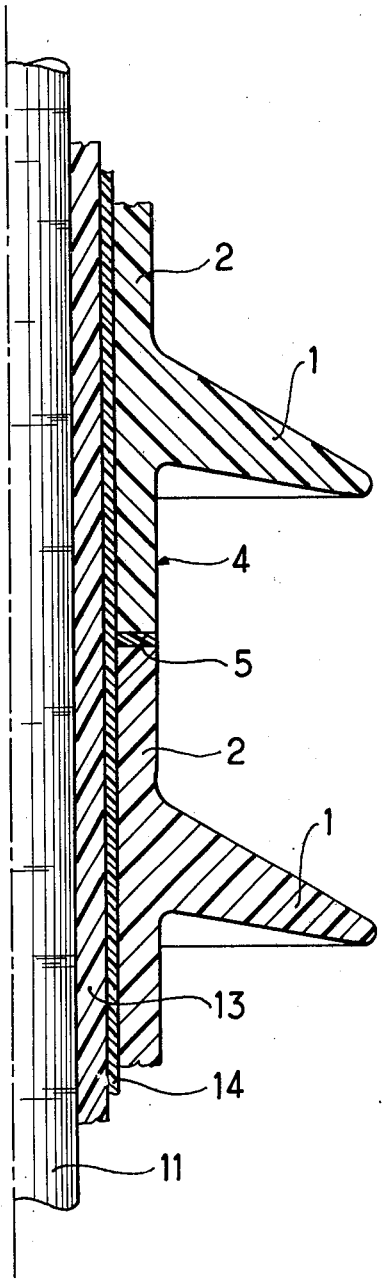
FIG. 5 is an axial section through another variant, using vulcanisation of a raw tape disposed over a vulcanised sheath covering the rod.

In another variant, shown in FIG. 5, the rod 11 is already covered with a vulcanised sheath 13 (an assembly analagous to the support shown in FIG. 2C), and is then further covered with a thin tape of raw elastomer 14 which may be positioned by unrolling onto the sheath 13. The vulcanised fins 1 are then threaded over the raw portion with raw thin sheets being interposed as before. The raw portions are then vulcanised together thereby providing double adherization between the sleeves themselves (rings 5) and between the sheath and the sleeves, in a manner similar to that described above.

We claim:

1. A method of manufacturing an insulator, said method comprising the steps of:

providing a plurality of fin units made of elastomer material, each fin unit comprising a sleeve bearing a bore, two end faces, and at least one fin projecting generally outwardly from said sleeve;

vulcanising said fin units;

providing washers of raw elastomer material and in the form of pierced portions of thin sheet material with the outside dimensions greater than the outside dimension of the end faces of the sleeves;

assembling the fin units in end-to-end relationship with their bores in alignment and with a washer held between adjacent pairs of sleeve end faces with excess sheet material projecting radially outwardly beyond the sleeves of adjacent fin units;

vulcanising the washers in situ to form a single multi-fin insulator; and removing the excess sheet material after vulcanisation of the washers such that the peripheries of the washers are flush with the sleeves of fin units on adjacent sides thereof to eliminate ingress of moisture between the sleeve end faces for prevention of arcing at the joint while eliminating the necessity of adhesives or adhesive primers and thereby providing an insulator having electrical insulation continuity throughout the length of the multiple fin unit formed insulator.

2. A method according to claim 1, wherein the same elastomer material is used for the fin units and for the washers.

3. A method according to claim 1, wherein the aligned bores of the sleeves hold a central member, said member being provided at least in part with an outer layer of raw elastomer and being inserted in the fin units before the washers are vulcanised, whereby the central member is made fast to the fin units by vulcanisation of its outer layer at the same time as the washers are vulcanised.

4. A method according to claim 3, wherein before vulcanisation of the washers and the outer layer, the central member includes a layer of vulcanised elastomer underneath the outer layer of raw elastomer.

5. A method according to claim 3, wherein the same elastomer material is used on the central member as is used for the washers.

6. A method according to claim 3, wherein the central member is entirely covered by the said outer layer.

7. An insulator formed by:

vulcanising fin units made of elastomer material, each fin unit comprising a sleeve bearing a bore, two end faces, and at least one fin projecting generally outwardly from said sleeve;

assembling the fin units in end-to-end relationship with their bores in alignment and with a washer of raw elastomer material extending over an area in excess of the area of the end faces of said sleeves with the washer held between adjacent pairs of sleeve end faces and with excess sheet material projecting outwardly from the sleeve end faces;

vulcanising the washers in situ to form a single multi-fin insulator of increased dielectric strength; and removing the excess sheet material after vulcanisation of the washers such that the remaining portions of said washers are flush with the sleeve portions of the fins to eliminate ingress of moisture at the joint and resultant arcing during insulator use at said joint, while providing electrical insulation continuity throughout the length of the insulator.

8. An insulator according to claim 7, further including a conductive central member such as the end of a high tension cable or a high-tension cross-over inserted in the bore of the aligned sleeves.

* * * * *